US005113638A

United States Patent [19]

Focke et al.

[11] Patent Number: 5,113,638

[45] Date of Patent: May 19, 1992

[54] PROCESS AND APPARATUS FOR PRODUCING (CIGARETTE) PACKS

[75] Inventors: Heinz Focke, Verden; Kurt Liedtke, deceased, late of Verden, both of Fed. Rep. of Germany, by Ruth Liedtke, legal representative

[73] Assignee: Focke & Co., (GmbH & Co.), Verden, Fed. Rep. of Germany

[21] Appl. No.: 629,888

[22] Filed: Dec. 19, 1990

[30] Foreign Application Priority Data

Dec. 19, 1989 [DE] Fed. Rep. of Germany ..... 3941844

[51] Int. Cl.[5] ..... B65B 7/22; B65B 7/24; B65B 19/20; B31B 3/00

[52] U.S. Cl. ..... 53/462; 53/234; 493/176; 493/465; 493/911

[58] Field of Search ..... 53/462, 456, 207, 563, 53/234; 493/465, 466, 460, 164, 176, 911, 910

[56] References Cited

U.S. PATENT DOCUMENTS

| | | | |
|---|---|---|---|
| 3,385,176 | 5/1968 | Whitaker | 53/234 X |
| 4,202,151 | 5/1980 | Focke et al. | 52/234 X |
| 4,392,338 | 7/1983 | Fox | 53/462 |
| 4,487,596 | 12/1984 | Livens et al. | 493/911 X |
| 4,708,704 | 11/1987 | Focke et al. | 493/176 X |

FOREIGN PATENT DOCUMENTS

| | | |
|---|---|---|
| 0205894 | 12/1986 | European Pat. Off. . |
| 464927 | 8/1928 | Fed. Rep. of Germany . |
| 528002 | 6/1931 | Fed. Rep. of Germany . |
| 7319344 | 5/1973 | Fed. Rep. of Germany . |
| 2442055 | 3/1975 | Fed. Rep. of Germany . |
| 2440006 | 3/1976 | Fed. Rep. of Germany . |
| 2813390 | 10/1979 | Fed. Rep. of Germany . |
| 3522614 | 1/1987 | Fed. Rep. of Germany . |
| 3738102 | 5/1989 | Fed. Rep. of Germany . |
| 450272 | 4/1968 | Switzerland . |
| 2091162 | 12/1982 | United Kingdom . |

*Primary Examiner*—James F. Coan
*Attorney, Agent, or Firm*—Sughrue, Mion, Zinn, Macpeak & Seas

[57] ABSTRACT

In the production of packs made of (thin) cardboard such as cigarette packs, complex folding processes may cause problems when blank portions are moved to the proper pack position, especially when blank portions are "too long" for the folding process. To remove this problem, the respective blank portion is, during the folding process, temporarily deformed in a way which shortens its effective length, i.e. curved in an arched manner. In the production of hinge lid packs having a collar (11) attached to a front wall (12) thereof in a single piece, this blank portion is, while being folded from an upright to a horizontal position, temporarily curved by a folding lever (58) applying pressure until the blank portion reaches the horizontal folding position.

16 Claims, 8 Drawing Sheets

PROCESS AND APPARATUS FOR PRODUCING (CIGARETTE) PACKS

BACKGROUND OF THE INVENTION

The invention relates to a process for producing (cigarette) packs, especially hinge lid packs made of a pack blank of (thin) cardboard and a collar blank connected therewith, with folding tabs being folded in succession into a finished pack position. The invention further relates to an apparats for conducting this process.

When packs made of relatively rigid pack material such as thin cardboard are produced, i.e. folded, problems often occur because portions of the blank can not be folded into their proper final position as a result of a constructional overlength. This problem for instance occurs in the production of hinge lid packs (for cigarettes), when the pack blank and a collar blank, which is commonly used in these type of packs, are formed in a single piece. Such a pack blank or a pack made thereof is for instance shown and described in DE-A-28 13 390. In this pack type, the collar blank is arranged on a front wall of a pack part.

The afore-mentioned technical problem in folding packs occurs when the portion consisting of pack front wall and collar blank is folded into the final position, especially from an upright position into a horizontal position to abutt the pack contents (cigarette block). In this folding movement, blank portions, namely collar side tabs, have to be inserted into a position between already folded blank portions and the pack contents. Due to lack of space, said portions can not be folded into the final folding position by just pivoting the pack front wall with collar blank.

SUMMARY OF THE INVENTION

The invention is generally concerned with the problem occuring when blank portions are folded which can not be moved into a folding position by means of a direct pivoting movement.

In order to remove this problem, the process as taught by the invention is characterized in that the relevant blank portions, especially the pack front wall including a collar blank connected therewith, are temporarily deformed, in particular curved in an arched manner, during the folding process to effect a shortening of the effective length of the respective blank portion.

In the practical embodiment concerning the production of a pack as shown in DE-A-28 13 390, the blank portion consisting of pack front wall and collar blank or front wall is outwardly bent in an arched manner which shortens the effective length of this blank portion. As a result, the collar side tabs can be inserted into the proper pack position. After the folding position has been reached, the blank portion is moved back into stretched-out position, i.e. into the normal position.

The blank portion is deformed or curved during the folding or pivoting movement of the blank portion by means of applying pressure in the plane of the blank portion, especially by applying pressure to a free edge thereof. In the embodiment mentioned above, this deforming pressure is applied to the free outer edge of the collar blank.

The apparatus as taught by the invention comprises a folding turret with pockets for receiving a blank or pack each. In the region of a filling station, a folding means is designed such that during the folding or pivoting movement, pressure is applied to the blank portion at the same time which deforms said blank portion in an arched manner. The folding means consists of a pivoting lever with a hook-shaped free end for grasping the outer edge of the blank portion, i.e. of the collar blank.

Further features of the invention relate to special folding steps for the production of a hinge lid pack consisting of a pack part and collar blank formed in a single piece and to details of the folding means (folding turret) for conducting the folding steps. Details of the process and the apparatus will be described in more detail in the following with reference to the drawings, in which:

DESCRIPTION OF A PREFERRED EMBODIMENT OF THE INVENTION

Figure 1:
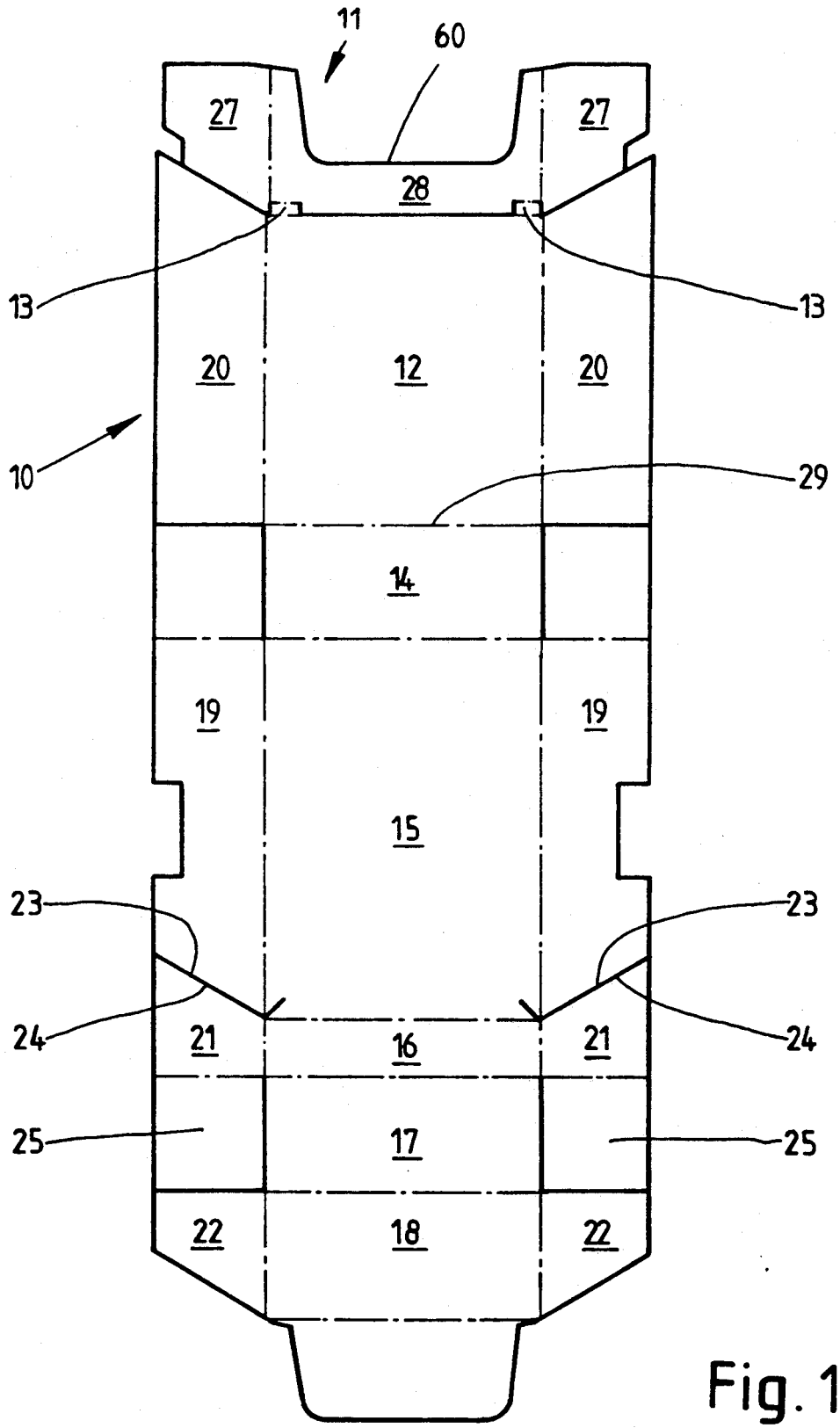
FIG. 1 shows a blank for a hinge lid pack with pack and collar blank formed in one piece, in stretched-out position.

The embodiment for process and apparatus as shown in the drawings relates to the processing of blanks according to DE-A- 28 13 390. Other blanks of similar design can also be used.

The blank (FIG. 1) consists of a pack blank 10 and a collar 11 formed in a single piece. This collar 11 is connected with the pack blank 10 in the region of a front wall 12, in this embodiment via web-like residual connections 13. These residual connections 13 are approximately folded in a Z-shape in order to position the collar 11 into the proper position relative to the pack blank 10, in which the collar 11, with its lower portion, rests against the inside of the front wall 12 (see for instance FIG. 2).

The pack blank 10 consists of further walls or wall portions, which are marked by folding lines within the blank. In the longitudinal direction of the pack blank 10, the front wall 12 adjoins a bottom wall 14 which adjoins a rear wall 15. The latter is connected to blank portions of a hinged lid, namely a lid rear wall 16, a lid top wall 17 and a lid front wall 18.

Lateral folding tabs adjoin the afore-mentioned blank portions, which particularly serve for forming pack side walls and lid side walls. The former consist of inner side tabs 19 which are connected to the rear wall 15 and of outer side tabs 20 arranged laterally on both sides of the front wall 12. Side tabs 19 and 20 cover one another in pairs to form the pack side walls. Correspondingly, on the lid rear wall 16 there are arranged trapezoidal lid side tabs 21 resting against the inside of the (folded) pack, and on the lid front wall 18 there are arranged appropriately designed outer lid side tabs 22.

The inner lid side tabs 21 form an extension of the side tabs 19 disposed on the rear wall 15 and are limited from these by an inclined cutting line, so that the side tabs 19 and the lid side tabs 22 are provided with inclined edges 23, 24 corresponding to one another.

The blank designed in the described manner is folded in analogy to the way described in DE-C-24 40 006. First, the blank is prepared by shifting the collar 11 relative to the pack blank 10 by way of folding the residual connections 13 in a Z-shaped manner. Then, an L-shaped intermediate folding position is created (FIG. 2), in which a (horizontal) arm consists of the rear wall 15 and the blank portions of the lid adjoining thereto. The other (upright) arm consists of bottom wall 14, front wall 12 and collar 11, each including the laterally attached blank portions. In this first folding process, the inner side tabs 19 connected to the rear wall and the inner lid side tabs 21 are also folded into an upright position, the latter together with lid corner tabs 25 attached thereto.

The necessary relative displacement of the collar 11 with respect to the pack blank 10 could also be conducted after the L-shaped intermediate folding position has been created.

The pack contents, i.e. in the present case a cigarette block 26 (a group of cigarettes with inner wrapping), are pushed into the intermediately folded pack with U-shaped cross-section in the longitudinal direction of the pack.

Figure 3:
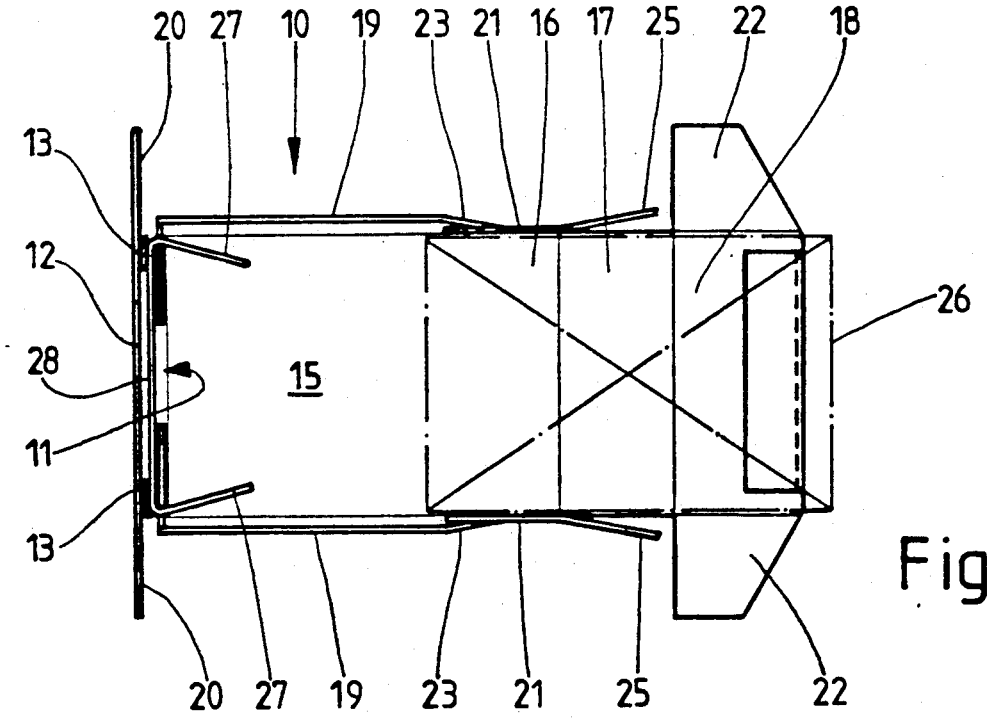
FIG. 3 is a plan view of the folding position as shown in FIG. 2.

In this first folding position, collar side tabs 27 are already folded into a position transverse to the collar front wall 28. FIG. 3 shows that the collar side tabs 27 are folded past the rectangular position into a relative position forming an acute angle with the collar front wall 28. This "overbending" of a folding portion has the purpose of overcoming restoring forces in the region of the folding edge. For the further folding steps, the collar side tabs 27 returns from an acute-angled position to a rectangular pack position.

The folding step following now comprises folding the front wall 12 with collar 11 into the horizontal position until it comes to rest against the pack contents, the technical folding problem here being to move the (folded) collar side tabs 27 into a position between pack contents (cigarette block 26) and the inner lid side tabs 21. This means that the collar side tabs 27 have to be inserted into a relatively narrow gap. Here, the inclined edges 23 and 24 of the side tabs 19 and lid side tabs 21, which are formed by the severing cut, form an obstacle, as they cause the collar side tabs 27 to get caught in the inserting process. The dimension of the front wall 12 and collar front wall 28, and the collar side tabs 27 extending up to the inside of the lid top wall 17 render the folding process more difficult.

To overcome this problem, the following steps are taken: The side tabs 19 as well as the lid side tabs 21 are moved into an inclined position in which the said lateral blank portions are directed in a V-shaped position relative to the upright side walls of the pack contents (cigarette block 26). Herewith, a (cuneiform) gap is formed at the longitudinal sides, into which the collar side tabs 27 of the collar 11 can be inserted when the front wall 12 with collar 11 and the collar side tabs 27 already folded into a transverse position are folded against the top face of the cigarette block 26 (FIGS. 4 and 5).

Figure 4:
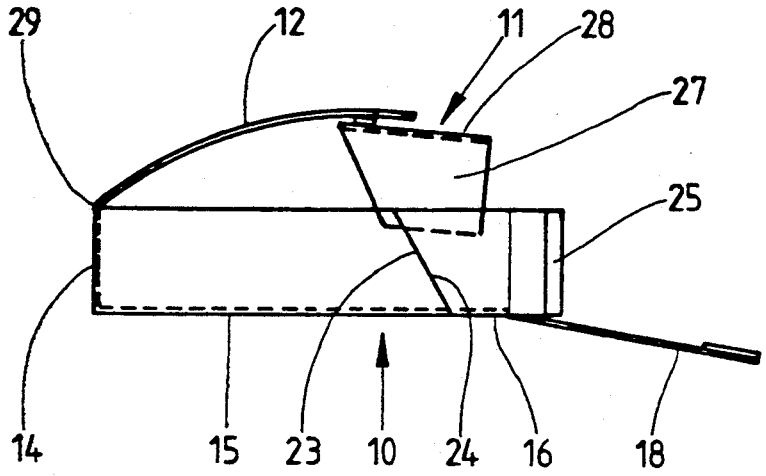
FIG. 4 shows the blank in a view according to FIG. 2 during the folding of a blank portion.
Figure 5:
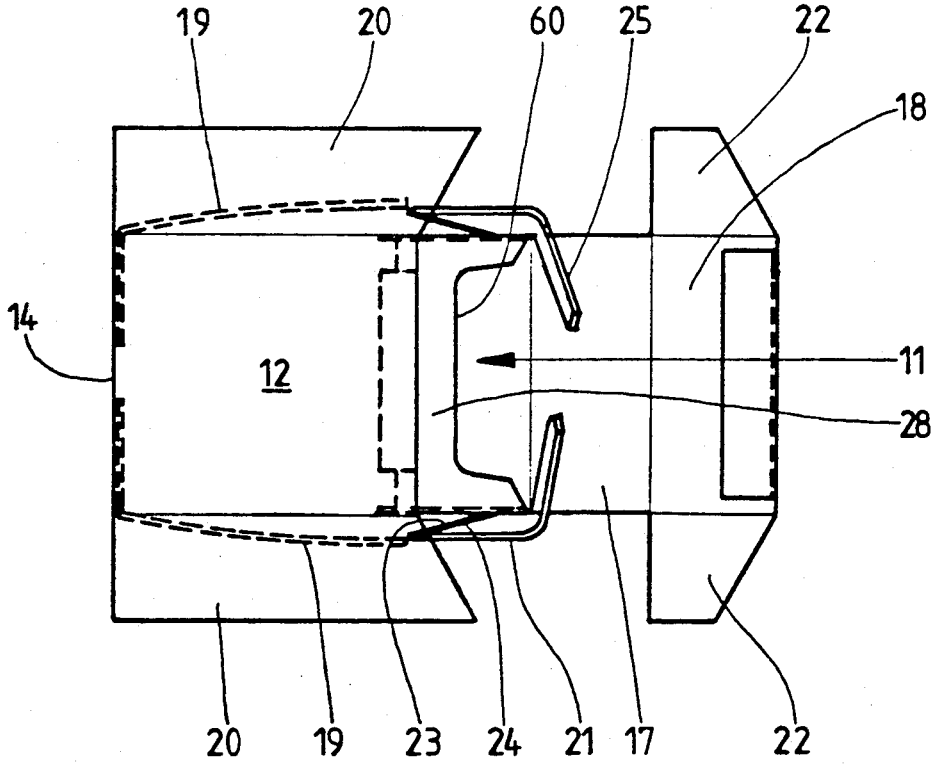
FIG. 5 is a plan view of the intermediate folding position according to FIG. 4.

During this folding movement, i.e. when the front wall 12 is folded over a folding edge 29 formed by itself and the bottom wall 14, the front wall 12 (with collar 11) is deformed such that it is upwardly or outwardly curved (FIG. 4). This results in a geometric shortening of the effective length of the folded blank portion, which is needed in the present case because at the point of folding the front wall 12 (with collar 11) at the radially outer side of the blank or partially folded pack, transversely directed blank portions obstruct the folding process, namely the already inwardly folded lid corner tabs 25 (FIG. 5) which obstruct the folding movement especially of the collar side tabs 27 into the final position. By shortening the effective length of the front wall 12 with collar 11 it is possible to fold the collar side tabs 27 into the proper position between lid side tabs 21 and pack content.

By shortening the effective length of front wall 12 and collar 11 it can also be avoided that the collar side tabs 27 get caught in the region of the inclined edges 23, 24 when they are inserted into the (cuneiform) gap. During the folding process, the collar side tabs 27 are in a relative position in which said inclined edges 23, 24 are covered (FIGS. 4 and 5).

After the collar side tabs 27 have been inserted into said lateral gap, that is to say when the collar front wall 28 comes to rest on the cigarette block 26, the deformation is removed. The front wall 12 moves into the original stretched-out position and now rests in pack position on the top face of the cigarette block 26. The outer side tabs 20 are still directed in the horizontal plane.

Now, further folding steps in analogy to the representations and description in DE-C-24 40 006 follow. These steps comprise the folding of side tabs 20, against the inner side tabs 19, and of the blank portions of the lid.

Figure 6:
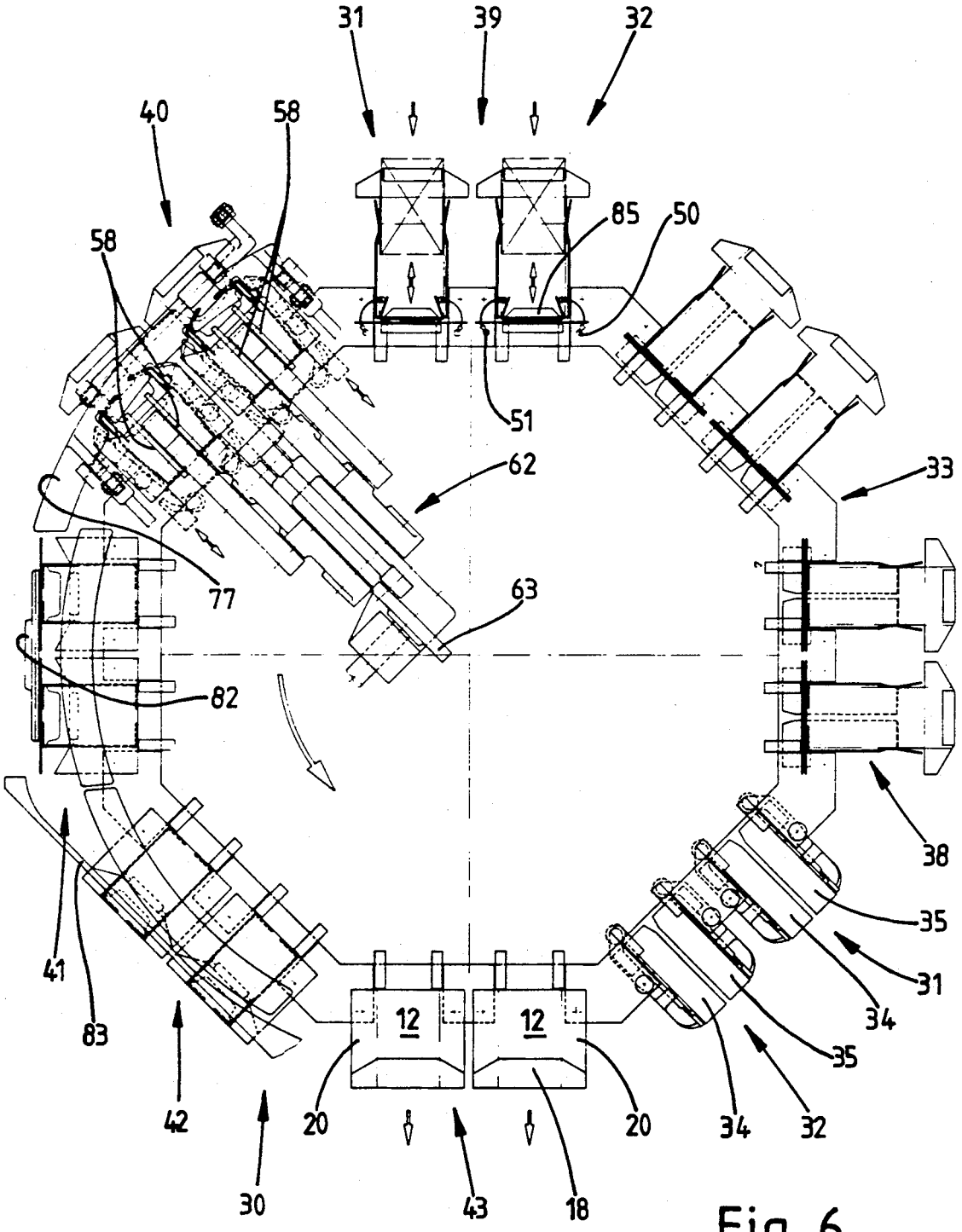
FIG. 6 is a plan view of details of a folding turret.

An essential part of the apparatus for conducting the described folding steps is a folding turret 30 (FIG. 6). In analogy to the folding turret as disclosed in DE-C-24 40 006,this folding turret 30 is designed as a flat, plate-like means and is rotatable (in fixed cycles) about a vertical axis. In the present embodiment, the folding turret 30 is designed for a dual track operation of the packaging machine. For this purpose, stations of the folding turret 30 are provided with two pockets 31, 32, each for receiving a pack or blank. The two pockets 31, 32 of one station are oriented parallel, with their longitudinal axes approximately radially directed. In pairs, the pockets 31, 32 are arranged on an octagonal turret disc 33. Each pocket 31, 32 essentially consists of two parallel supporting arms 34, 35 spaced apart from one another. These are open on the radially outward side. At the inside, they are connected with a downwardly directed edge 36 of the turret disc 33. An angular stop 37 limits the pockets at the radially inward side.

Figure 7:
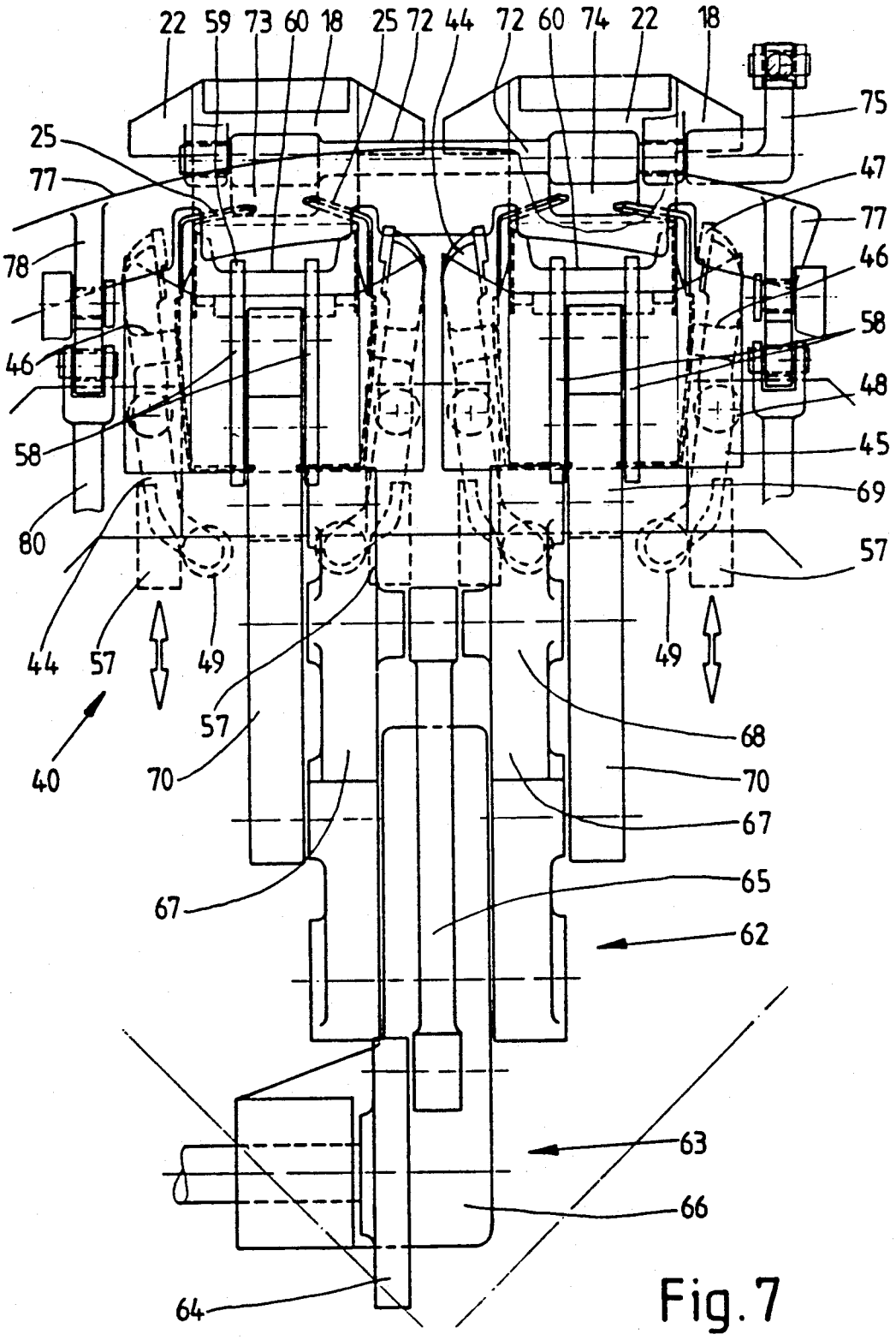
FIG. 7 is a plan view of a folding station of the folding turret according to FIG. 6, on an enlarged scale.

The pockets 31, 32 designed in this way pass through several working stations of the folding turret 30. In the region of a blank station 38, the blanks 10 are introduced from above into the open pockets 31, 32. An intermediate station is followed by a feed station 39. Here, the cigarette blocks 26 are pushed into the partially folded blanks 10 located in the pockets 31, 32 in the radial direction. In a folding station 40 (FIGS. 6 and 7) following downstream of the feed station, the folding steps described in connection with FIGS. 2 to 5 are conducted. Further folding stations 41 and 42 follow, in which the folding of the blanks is continued. In the region of an ejecting station 43 located diametrically opposite the feed station 39, the nearly finished packs are ejected from the pockets 31, 32 in the radial direction onto a (linear) discharge conveyor (not shown).

In the blank station 38, two blanks at a time are simultaneously introduced into the pockets 31, 32 from above, specifically by means of punches. The blanks are delivered to the blank station 38 on parallel blank tracks located above the folding turret 30. In this respect, the apparatus is designed in analogy to that of DE-C-24 40 006.

Figure 2:
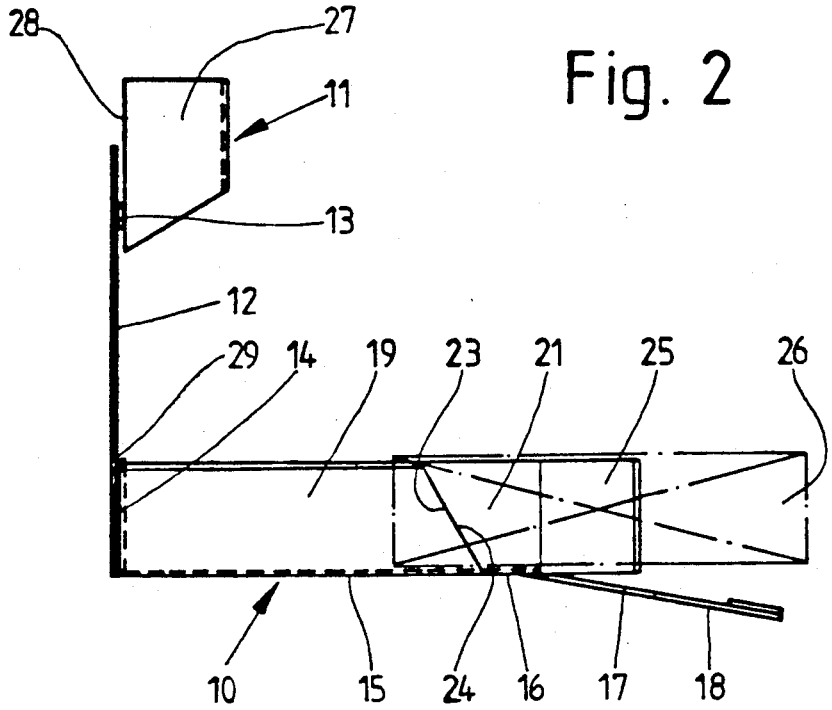
FIG. 2 is a side view of an L-shaped intermediate folding position of the blank.

The blank introduced into the pockets 31, 32 directly receive the folding position according to FIGS. 2 and 3, but with the collar side tabs 27 extending into the plane of the front wall 12. Now, the residual connections 13 of the collar 11 can be folded in a Z-shaped form unless they have already been folded before the blank was introduced into the pocket.

The blanks folded thus far are fixed in the pockets 31, 32 by retaining levers 44, 45 laterally attached thereto. These levers 45, 45 are designed in the same way and can be actuated in a similar way to those of the apparatus according to EP-B-0 205 894. In the present embodiment, the retaining levers 44, 45 rest with a transversely directed web 46 on an upper edge of lateral upright blank portions, namely on the side tabs 19. As a result, the blanks are secured against being upwardly displaced. The retaining levers 19 engage the inclined edge 23 of the side tab 19 with an angular-shaped or profiled head member 47. Thus, the blank is secured against being radially (outwardly) displaced in the pocket 31, 32.

The retaining levers 44, 45 are pivoted next to the pockets, 31, 32 on pivot bearings 48 and designed as two-armed levers. Free ends of the retaining levers 44, 45 are provided with scanning rollers 49. In the present case, these are actuated by curved members 57 movable to and fro approximately in the radial direction, on which the scanning rollers 49 run along. The retaining levers 44, 45 are actuated such that the head members 47 and the web 46 pivot away from the blanks, thus releasing them for being ejected from the pockets 31, 32 or for further folding steps.

With the retaining levers 44, 45 being in retaining position, the pockets 31, 32 with the blanks arrive at the feed station 39. Here, the cigarette blocks 26 supplied on parallel tracks are introduced into the pockets 31, 32 being open at the outer side of the folding turret and herewith into the blanks.

At the same time, the collar side tabs are folded in the described way in the feed station 39.

Figure 10:
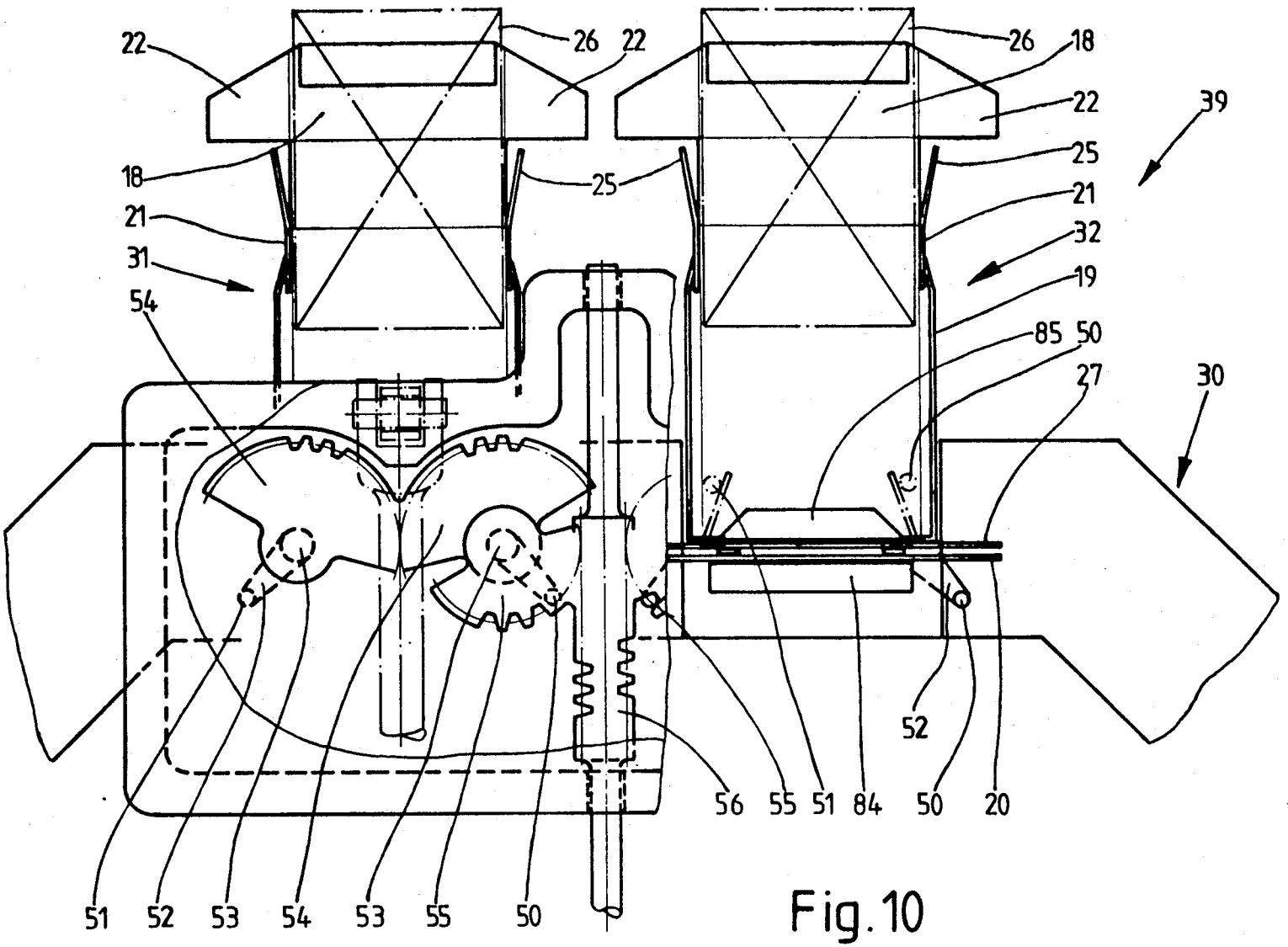
FIG. 10 is a plan view of the folding station according to FIG. 7 with different folding means.

For this purpose, folding means arranged in the feed station 39 stationary on the turret 30 are assigned to the pockets 31, 32. In the present embodiment, these folding means are folding pins 50, 51 arranged above the pockets 31, 32 or blanks. These folding pins 50, 51 are upwardly directed and movable along an arc of a circle. For folding the collar side tabs 27 they are moved from a starting position (FIG. 10: solid lines) up to the region above the pockets 31, 31 and take along the collar side tabs 27. Herewith, the collar side tabs 27 are temporarily moved into the acute-angled position.

The upright folding pins 50, 51 are each arranged on a pivoting lever 52, which in the horizontal plane can be pivoted to and fro along a partial circle. The pivoting levers 52 are pivoted in a pivot bearing 53 and are each connected to a toothed segment 54. The toothed segments 54 of the two folding pins 50, 51 assigned to a pocket 31, 32 engage one another, such that rotary motions of the one toothed segment are transferred to the other. As a result, the folding pins 50, 51 are always actuated together.

The folding pins 50, 51 of adjacent pockets 31, 32 face one another and are furthermore associated with a toothed drive segment 55 each. Said drive segment 55 engages a common central toothed rack 56 for driving the four folding pins 50, 51 of the two pockets 31, 32. The toothed rack 56 can be moved backwards and forwards.

When the collar side tabs 27 are folded by the folding pins 50, 51, the upright arm of the blank (front wall 12 with collar front wall 28) is fixed. For this purpose, two webs are provided, namely a stationary outer web 84 and a movable counter web 85. The latter has a trapezoidal cross-section, so that the collar side tabs 27 can be folded into an acute-angled position. The webs 84 and 85 are appropriately pivoted and movable, so that the blank portions can be moved past them without any obstructions when the folding turret 30 is rotating.

Now, the pockets 31, 32 arrive at the particularly important folding station 40, in which relatively complex folding processes are conducted.

The most important folding step consists of folding the upright arm of the blank, comprising the front wall 12 with the blank portions attached thereto, into the horizontal position where it comes to rest against the pack contents. In this process, the difficulties described further above (FIGS. 4 and 5) have to be overcome.

Figure 8:
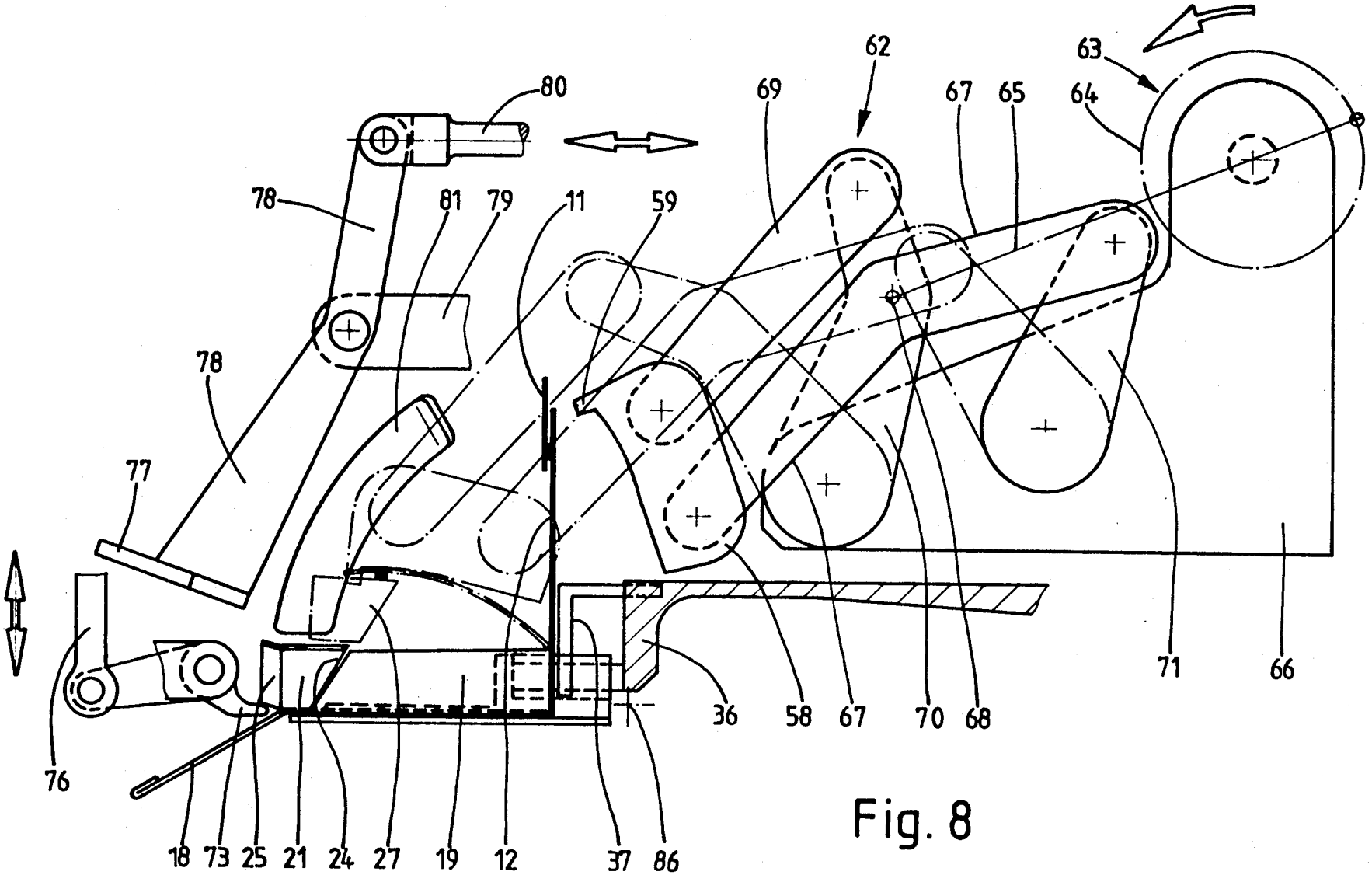
FIG. 8 shows the folding station according to FIG. 7 in a radial section of the folding turret with folding means.

The front wall 12 is folded by a folding lever 58 which is designed and actuable in a special way. At a free end directed towards the blank, the folding lever 58 has a hook-shaped lug 59. This projection positively engages the (for now) upright arm of the blank. The folding lever 58 is arranged such that setting out from the starting position as shown in FIG. 8 and a movement directed to the outer edge of the folding turret 30, an upper (transverse) edge of the blank is engaged. In the present case, this is an upper free outer edge 60 of the collar front wall 28 provided with a (customary) indentation. The operating motions of the folding lever 58 are such that the upright blank portion (front wall 12 with collar 11) being in the position as shown in FIG. 8 is engaged by the folding lever 58, bent over the folding edge 29 between front wall 12 and bottom wall 14, and moved into a horizontal position. During this folding movement, the front wall 12 with collar front wall 28 is deformed in an arched manner (FIG. 8) and thus effectively shortened. Part of the front wall 12 abutts the folding lever 58. In final position of this movement, front wall 12 and collar front wall 28 are stretched out again. As the folding lever 58 is moved further, it disengages the blank and moves back into the starting position as shown in FIG. 8.

During the described folding movement, a pressing force is applied to the blank portion consisting of front wall 12 and collar front wall 28 which causes the arch-like deformation. Said pressing force is introduced via the outer edge 60. The inner delimitation of the pocket 31, 32, i.e. the angular stop 37, acts as a counter support. The front wall 12 with folding edge 29 is braced by said angular stop 37.

The folding lever 58 is moved by a control mechanism 62 consisting of links and levers. This mechanism 62 is driven by a stationary crank 63 comprising crank wheel 64 and connecting rod 65. The crank 63 is mounted on a stationary support frame 65.

The crank 63 takes effect on a main actuating lever 67, which in this embodiment is angular-shaped and which the connecting rod 65 engages approximately in a center region (bearing 68). The main actuating lever is flexibly linked to the folding lever 58. A further actuating lever 69 extending approximately parallel to an arm of the main actuating lever 67 is also flexibly linked to said folding lever 58.

Figure 9:
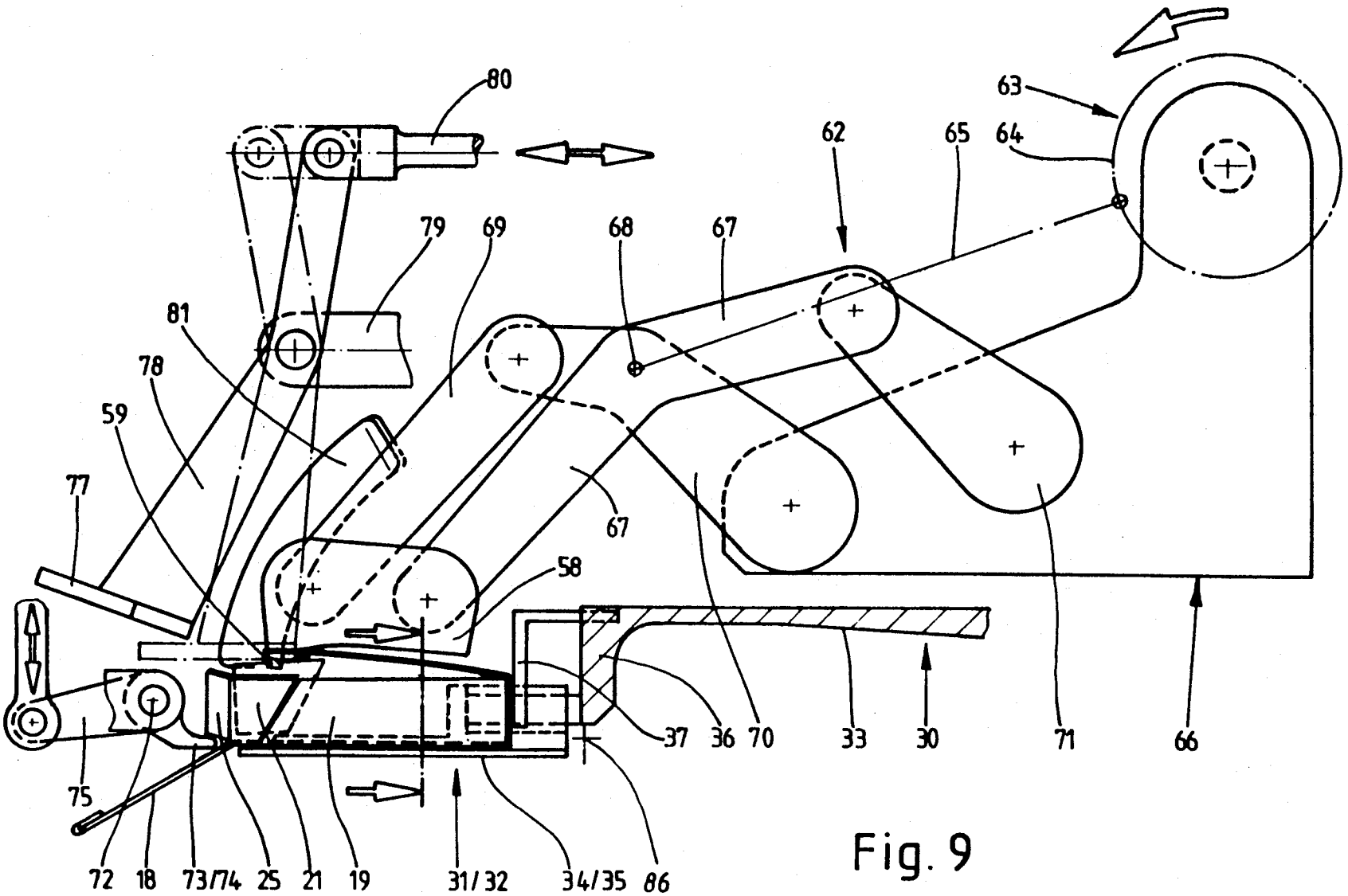
FIG. 9 is a representation according to FIG. 8 with the folding means being in a different relative position.

Main actuating lever 67 and actuating lever 69 are flexibly linked to a first supporting lever 70. A further supporting lever 71 is connected to the free end of the main actuating lever 67. The two supporting levers 70, 71 are pivoted on the support frame 66. This design of the control mechanism 62 with levers having adapted lengths and relative positions, causes the folding lever 58 to conduct a movement along an arc of a circle, the center 86 of which being located at a considerable distance from folding lever 58. During the movement along the arc of a circle about the center point 86, the folding lever 58 is at the same time rotated about its own axis, namely from the upright starting position as shown in FIG. 8 to a nearly horizontally direction final position as shown in FIG. 9. The center point 86 of the rotary motion is also located at a distance from the folding edge 29 of the front wall 12, namely downwardly displaced as well as inwardly relative to the radial direction of the folding turret 30. Only this relative position makes it possible to obtain the afore-described folding geometry of the front wall 12 with collar 11. Important features are the position of the center point 86 of the pivoting movement of the folding lever 58 below the axis of rotation for the front wall 12 and the lateral displacement thereto. Only this arrangement guarantees that in the upright starting position, the lug 56 engages the outer edge 60 without any obstructions and disengages the same in the folded horizontal position of the front wall 12.

These folding processes are conducted simultaneously in the region of the two pockets 31, 32. For this purpose, two control mechanisms 62 are provided in the region of the folding station 40. In the present embodiment, however, only one crank 63 is arranged centrally relative to the two pockets 31, 32. The common connecting rod 65 is connected to two main actuating levers 67. Apart from the connecting rod 65, the other mechanism parts are provided in pairs.

In the shown embodiment, the folding lever 58 is formed by two partial levers. Said partial levers are arranged on both sides of the main actuating levers 67 and of the actuating lever 69. This means that the outer edge 60 of the collar 11 is engaged at two lateral regions during the folding movement.

While the described folding movements are conducted, the holding levers 44, 45 of the pockets 31, 32 are pivoted back, i.e. they are not in engagement with the blank. As a result, the side tabs 19 arranged on the rear wall 15 move into a V-shaped inclined position within the pocket 31, 32 (FIG. 5). For this purpose, side walls of the pockets 31, 32, i.e. upright walls of the supporting arms 34, 35 are also designed in an inclined or upwardly diverging manner.

To ensure an inclined V-shaped position in the region of the (inner) lid side tabs 21 as well, which facilitates the insertion of the collar side tabs 27, these blank portions are appropriately deformed. For this reason, a deforming means is disposed which in the present embodiment takes effect on the already slightly inwardly folded lid corner tabs 25 by lifting them up. The lid side tabs 21 are thus deformed in a V-shaped manner as a result of a pivoting movement.

In the shown embodiment, two lifting fingers 73, 74 are arranged in the folding station 40 at the outer edge of the folding turret 30 on a shaft 72. These lifting fingers 73, 74 are located approximately in the center region in front of the end faces of the pockets 31, 32. The dimensions of the lifting fingers 73, 74 are chosen such that with a pivoting movement caused by rotating the shaft 72, the end portions of the two lid corner tabs 25 facing one another are lifted. This effects the described inclined position of the lid side tabs 21.

The shaft 72 can be actuated via an actuating arm 75 arranged at its end by means of a thrust rod 76.

The folding station 40 is associated with an upper guide 77 which consists of a circular strip made of flat material which in active position (FIG. 7 and dot-dash lined in FIG. 9) extends above the folded collar 11 and retains said folded collar 11 in the folding station 40 and during a stage of the subsequent rotary motion of the folding turret 30 in the folding position. For conducting the afore-described folding process, the upper guide can be moved out of the active position into the starting position indicated by solid lines in FIG. 9.

For this purpose, the upper guide 77 is attached to two pivoting levers 78 spaced apart from one another. These pivoting levers 78 are pivoted on a supporting arm 79. At the free end of the two-armed pivoting levers 78, there is arranged an actuating rod 80 for conducting the pivoting movements.

When front wall 12 and collar 11 are moved into the folding position by the folding lever 58, the lateral retaining levers 44, 45 return to the retaining position. As a result, the side tabs 19 and the lid side tabs 21 are moved back to the upright position. Thereafter, the folding lever 58 returns to the starting position and now the upper guide 77 can be pivoted into active position. Then, the folding turret 30 is rotated by one fixed cycle.

Stationary lateral guides 81 (FIG. 9) are arranged in the region of the folding station 40 for guiding the collar side tabs 27 when front wall 12 and collar 11 move down. These lateral guides 81 terminate above the pocket 31, 32, such that they do not form an obstruction when the folding turret 30 moves further. The lateral guides 81 are arranged in a curved manner, corresponding to the folding movement of the collar side tabs 27.

In the folding station 41 following now, a portion of the blank consisting of lid front wall 18 and lid top wall 17 is folded into an upright position. For this reason, the two pockets 31, 32 are provided with a common folding means 82 in this folding station 41. This folding means 82 is an essentially up and downwardly movable folding web, which erects said blank portions by means of the upward movement, the lid top wall 17 thus coming to rest against the end face of the pack contents (cigarette block 26).

Further downstream follows another folding station 42, in which the temporarily upright lid front wall 18 is folded against the pack contents, that is to say against the projecting portion of the collar 11 by means of a stationary folding bar 83. In a manner known per se, this folding process is conducted during the rotary motion of the folding turret 30 relative to a stationary folding means (folding bar 83), which is located in the path of motion of the pockets 31, 32 above these pockets.

The nearly completely folded packs then reach the ejecting station 43. After the packs have been ejected from the folding turret, only the transversely projecting outer side tabs 20 and the outer lid side tabs 22 still have to be folded over. Before that, glue is applied to these blank portions in the known manner.

What is claimed is:

1. In a process for producing hinge lid packs made of a pack blank of cardboard and a collar blank connected therewith, with folding blank tabs being in succession folded to a finished pack position, the improvement comprising the step of temporarily deforming blank portions in an arched shape, during the folding process, such that the effective length of the respective blank portions is shortened.

2. The process as claimed in claim 1, further comprising the steps of:

bending a blank portion in an arched shape while it is folded from an upright starting position into a horizontal final position, until said blank portion reaches the final position; and then moving said blank portion to a proper stretched-out pack shape.

3. The process as claimed in claim 1 or 2, further comprising the step of applying to the blank portion a pressing force for creating the arched shape, said pressing force taking effect on at least one free edge of the blank portion and on an oppositely situated region of the blank portion which is braced against this pressing force.

4. The process as claimed in claim 1, wherein the blank portion which is to be deformed is folded, while being temporarily curved in an arched manner, from an upright stretched-out starting position to a horizontal final pack position in which it rests against the pack contents.

5. The process as claimed in claim 4, further comprising the steps of: moving lateral blank portions into an approximately upright folding position; and then folding collar side tab blank portions (27) into a transversely directed position during the folding movement of a pack front wall blank portion (12) and a collar blank portion (11) into a position between the pack contents (26) and the lateral blank portions (19), (21).

6. In an apparatus for producing packs made from cardboard blanks having blank portions which, in the region of a folding unit, are in succession foldable into a final pack position, the improvement comprising folding means (58) which folds a blank portion, and which, in the folding movement, effects a deformation of the blank portion to shorten the effective length thereof.

7. The apparatus as claimed in claim 6, wherein said folding means (58), during the folding movement of the blank portion (12), (28), applies a pressure to the blank portion to effect deformation thereof.

8. The apparatus as claimed in claims 6 or 7, wherein said folding means is a pivotable folding lever (58), having a hook-shaped free end (59) for engaging a free edge (60) of the blank portion.

9. The apparatus as claimed in claim 6, wherein said folding means is a folding lever (58) for engaging an upright blank portion (12/28), and means for simultaneously moving and pivoting said folding lever (58) from an approximately upright starting position along an arc of a circle into an approximately horizontal position with the blank portion (12/28) being stretched out and horizontally directed.

10. The apparatus as claimed in claim 9, further comprising a control mechanism (62) for actuating said folding lever (58), said control mechanism (62) comprising two supporting levers (70,71), mounted in fixed location, and two approximately parallel actuating levers (67,69) pivotally connected to said supporting levers (70,71) and to said folding lever (58).

11. The apparatus as claimed in claim 10, wherein said control mechanism (62) has a bearing (68) and is driven by a crank (63) having a crank rack (65) which is connected to said bearing (68) of said control mechanism (62).

12. The apparatus as claimed in claim 6, wherein said folding unit is a folding turret (30), wherein collar side tab blank portions (27) connected to a collar front wall blank portion (28) are foldable, with a pack front wall (12) and a collar (11) being in upright position, by said folding means (50, 51) into a pack position transverse to the collar front wall (11), said folding means (50, 51) being pivoted in a region of a feed station (39) of said folding turret (30), and said folding means being movable at a level of the collar side tabs (27) from a retracted position along an arc of a circle (27) and, in this movement, taking along the collar side tabs (27) to a position in which they are directed to an acute angle relative to the collar front wall (28).

13. The apparatus as claimed in claim 12 further comprising pressure-applying means, wherein, when or after a blank (10) is inserted into a pocket (31, 32) of said folding turret, lateral blank portions, including side tabs (19), lid side tabs (21) and lid corner tabs (25), are folded into a nearly upright, V-shaped position, said lid corner tabs (25) being movable into the V-shaped position by pressure being applied by said pressure-applying means to the inwardly folded lid corner tabs (25).

14. The apparatus as claimed in claim 13, further comprising lifting means (73, 74), wherein the inclined lid corner tabs (25) are liftable by said lifting means in order to temporarily move side tabs (19) and lid side tabs (21) into said V-shaped folding position.

15. The apparatus as claimed in claim 6, comprising a stationary curved upper guide (77) for partially folded packs in the region of at least a folding station (40), said curved upper guide (77) being made of a flat material and being movable during the folding movement of a pack front wall (12) and a collar front wall (28) out of the path of motion thereof and, thereafter, being movable back into a position directly above the collar (11).

16. The apparatus as claimed in claim 15, wherein said upper guide (77) is mounted on a pivoting lever (78) above the path of motion of the folding turret (30) in the region of the folding station (40).

* * * * *